United States Patent [19]

Smith

[11] 4,083,537

[45] Apr. 11, 1978

[54] LINT REMOVING APPARATUS

[75] Inventor: Eldrew P. Smith, Prattville, Ala.

[73] Assignee: Ring Around Products, Inc., Prattville, Ala.

[21] Appl. No.: 725,930

[22] Filed: Sep. 23, 1976

[51] Int. Cl.[2] ..... B01F 7/00

[52] U.S. Cl. ..... 366/147; 366/168; 366/329

[58] Field of Search ..... 259/6, 9, 10, 25, 26, 259/41, 45, 46, 103, 109, 110, DIG. 18

[56] References Cited

U.S. PATENT DOCUMENTS

| | | | |
|---|---|---|---|
| 379,498 | 3/1888 | Gelder | 259/6 |
| 393,635 | 11/1888 | Fisher | 259/9 |
| 1,303,143 | 5/1919 | Albers | 259/45 X |
| 1,569,201 | 1/1926 | Piersall | 259/25 X |
| 1,897,361 | 2/1933 | Calkins | 259/6 |
| 3,360,245 | 12/1967 | Peach | 259/25 |

*Primary Examiner*—Edward J. McCarthy
*Attorney, Agent, or Firm*—Rogers, Eilers & Howell

[57] ABSTRACT

Dilute sulphuric acid is added to, and thoroughly mixed with, lint-bearing cotton seeds to saturate the lint on those lint-bearing cotton seeds. The resulting acid-treated lint-bearing cotton seeds have heated air passed adjacent to and around them while they are thoroughly stirred. The resulting dried acid-treated lint-bearing cotton seeds have the lint separated therefrom by being recurrently forced into engagement with other cotton seeds. The adding and mixing of the acid, the drying of the acid-treated lint-bearing cotton seeds, and the separating of the lint from the dried acid-treated lint-bearing cotton seeds are performed on a continuous basis rather than on a batch basis.

26 Claims, 11 Drawing Figures

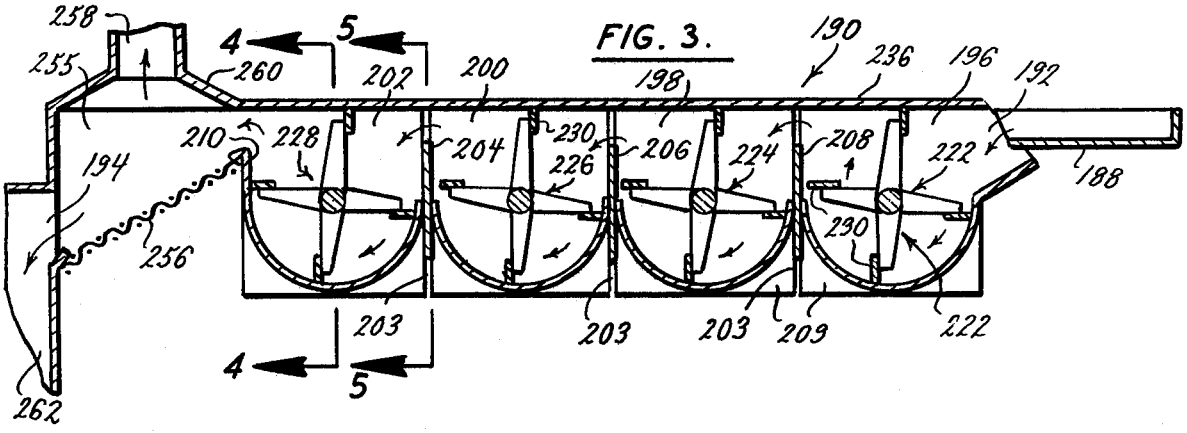
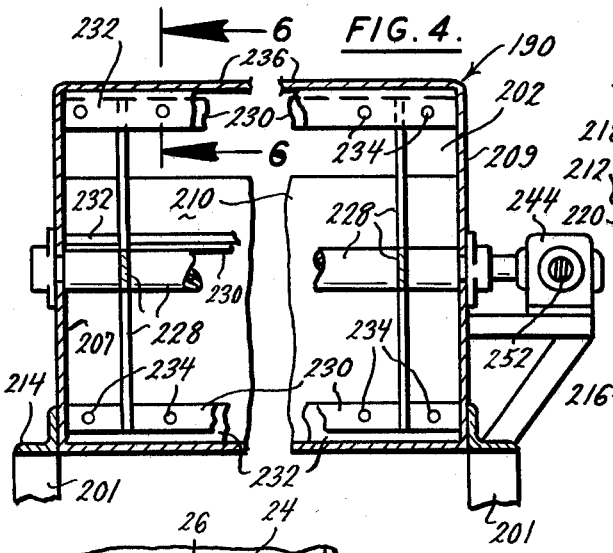
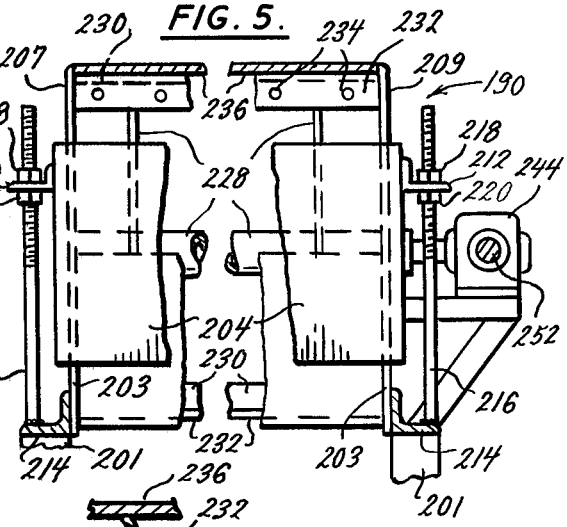
FIG. 6.
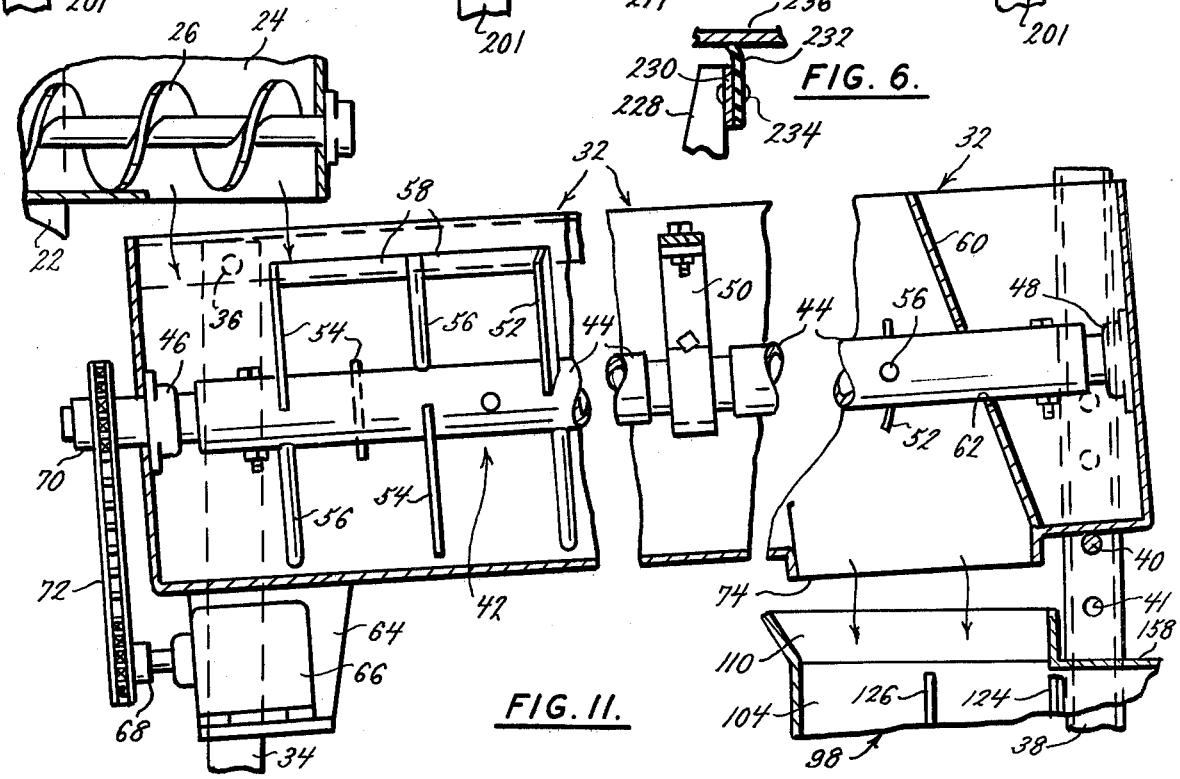
FIG. 11.

LINT REMOVING APPARATUS

BACKGROUND OF THE INVENTION

When cotton fibers are separated from cottonseeds in cotton gins, some of those fibers remain attached to those seeds in the form of lint. It is desirable to removed that lint from those seeds; and, for many years, that removal has been effected by exposing those seeds to open flames to singe the lint thereon or by immersing those seeds in concentrated sulphuric acid to dissolve the lint thereon. Recently, Cotton Incorporated has disclosed the saturation of the lint on cotton seeds with dilute sulphuric acid, the drying of the acid-treated lint-bearing cotton seeds, and the mechanical removal of the lint from the dried acid-treated lint-bearing cotton seeds.

SUMMARY OF THE PRESENT INVENTION

Dilute sulphuric is added to, and thoroughly mixed with, lint-bearing cotton seeds to saturate the lint on those lint-bearing cotton seeds. The weight of concentrated sulphuric acid bears to the weight of the dilute sulphuric acid substantially the same ratio which the weight of the lint bears to the combined weight of the cotton seeds and the lint thereon; and the weight of the dilute sulphuric acid is only ten percent to 35 percent of the weight of that lint. The mixing of the dilute acid with the lint-bearing cotton seeds is so thorough that the acid-treated lint-bearing cotton seeds are not wet and, instead, are damp-dry. It is, therefore, an object of the present invention to add to lint-bearing cotton seeds an amount of dilute sulphuric acid which is in the range of ten percent to 35 percent of the weight of the lint on those cotton seeds, and to mix that dilute sulphuric acid and those lint-bearing cotton seeds so thoroughly that the resulting acid-treated lint-bearing cotton seeds are damp-dry.

The mixing of the dilute sulphuric acid and lint-bearing cotton is effected by a seed stirring and moving member which has elements thereon that recurrently pass through the mixture of dilute sulphuric acid and lint-bearing cotton seeds to part, and then permit the re-uniting of, the acid-treated lint bearing cotton seeds without applying advancing forces to those acid-treated lint-bearing cotton seeds. Further, that seed stirring and moving member has further elements thereon that recurrently pass through the mixture of dilute sulphuric acid and lint-bearing cotton seeds to force the lint-bearing cotton seeds to move laterally without applying advancing forces to those acid-treated lint-bearing cottons seeds. Those elements and those further elements of the seed stirring and moving member recurrently develop and release compressive forces within the acid-treated lint-bearing cotton seeds and also provide relative movement between adjacent acid-treated lint-bearing cotton seeds. It is, therefore, an object of the present invention to provide a seed stirring and moving member which has elements thereon and which has further elements thereon that do not advance lint-bearing cotton seeds of a mixture of dilute sulphuric acid and lint-bearing cotton seeds but which recurrently pass through that mixture to part, and then permit the re-uniting of, the acid-treated lint-bearing cotton seeds and which force those acid-treated lint-bearing cotton seeds to move laterally.

A similar seed stirring and moving member is used to stir the acid-treated lint-bearing cotton seeds while heated air is passed adjacent to and around those acid-treated lint-bearing cotton seeds. A temperature-sensing device is disposed in the path of, and is engaged by, the heated acid-treated lint-bearing cotton seeds; and that temperature-sensing device will keep the heated air from unduly raising the temperature of the heated acid-treated lint-bearing cotton seeds. Specifically, that temperature-sensing device will keep the heated air from raising the temperature of the heated acid-treated lint-bearing cotton seeds to 140° Fahrenheit. It is, therefore, an object of the present invention to pass heated air adjacent to and around acid-treated lint-bearing cotton seeds while those acid-treated lint-bearing cotton seeds are being thoroughly stirred, and to keep the temperature of the heated acid-treated lint-bearing cotton seeds below 140° Fahrenheit.

The dried acid-treated lint-bearing cotton seeds have the lint separated therefrom by being recurrently forced into engagement with other cotton seeds. Specifically, seed-moving members recurrently force the dried acid-treated lint-bearing cotton seeds downwardly toward the bottoms of, and then upwardly toward the tops of, chambers which contain cotton seeds; and, in doing so, those seed-moving members recurrently force those dried acid-treated lint-bearing cotton seeds to move downwardly into and through compressed masses of cotton seeds. Also, those seed-moving members recurrently force the dried acid-treated lint-bearing cotton seeds to move out of the paths of those seed-moving members and thereafter permit those dried acid-treated lint-bearing cotton seeds to move into position behind those seed-moving members. The resulting relative movement between the dried acid-treated lint-bearing cotton seeds and adjacent cotton seeds mechanically separates the lint from the dried acid-treated lint-bearing cotton seeds without injuring or impairing the quality of those dried acid-treated lint-bearing cotton seeds. It is, therefore, an object of the present invention to recurrently force dried acid-treated lint-bearing cotton seeds downwardly toward the bottoms of, and then upwardly toward the tops of, chambers which contain cotton seeds to mechanically separate the lint from the dried acid-treated lint-bearing cotton seeds without injuring or impairing the quality of those dried acid-treated lint-bearing cotton seeds.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

In the drawing, FIG. 3 is a sectional view, on a larger scale, through the lint-separating portion of the lint removing apparatus of FIG. 1, and it is taken along the plane indicated by the line 3—3 in FIG. 1, FIG. 4 is a broken sectional view, on a still larger scale, through the lint-separating portion of the lint removing apparatus of FIG. 1, and it is taken along the plane indicated by the line 4—4 in FIG. 3, FIG. 5 is another broken sectional view, on the scale of FIG. 4, through the lint-separating portion of the lint removing apparatus of FIG. 1, and it is taken along the plane indicated by the line 5—5 in FIG. 3, FIG. 6 is a sectional view, on an even larger scale, through a portion of the structure shown in FIG. 4, and it is taken along the plane indicated by the line 6—6 in FIG. 4, FIG. 11 is a broken sectional view, on the scale of FIG. 7, through the acid-treating portion of the lint-removing apparatus of FIG. 1, and it is taken along the plane indicated by the line 11—11 in FIG. 10,

DESCRIPTION OF THE PREFERRED EMBODIMENT

Figure 1:
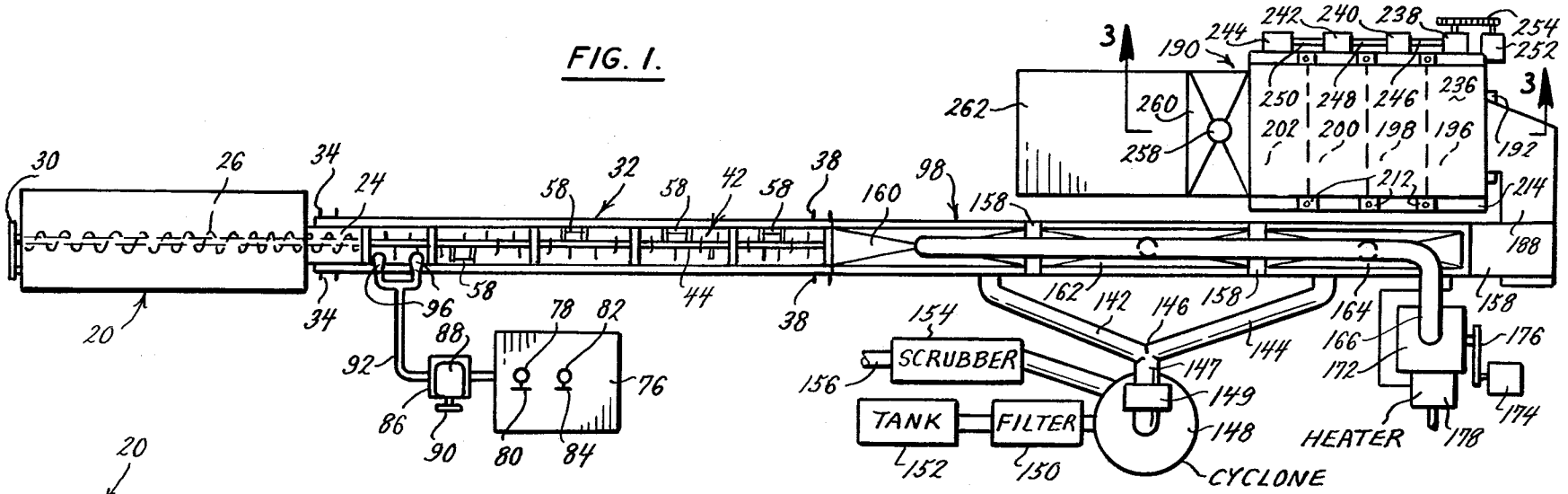
FIG. 1 is a plan view of one preferred embodiment of lint removing apparatus which is made in accordance with the principles and teachings of the present invention.

Referring to the drawing in detail, the numeral 20 generally denotes a bin in which lint-bearing cotton seeds can be held prior to the time they are introduced into the lint-removing apparatus provided by the present invention. That bin has leg-like supports 22 at the four corners thereof, and those supports hold the bottom of that bin spaced a considerable distance above the ground. The numeral 24 denotes an enclosed outlet for the bin 20, but the bottom of that enclosed outlet is open. An elongated seed-advancing auger 26 is rotatably mounted within the bin 20 by suitable bearings, not shown, at the left-hand of that bin and at the right-hand end of the enclosed outlet 24. The numeral 28 denotes an electric motor which is suitably mounted on a bracket 27 at a point below the bin 20. A flexible drive 30, such as a chain or belt, connects the output shaft of motor 28 to the shaft of auger 26. Whenever that motor is operated, that auger will advance lint-bearing cotton seed within the bin 20 to and through the enclosed outlet 24.

The numeral 32 generally denotes an elongated container which has the left-hand end thereof disposed beneath the enclosed outlet 24 of bin 20. Leg-like supports 34 extend upwardly from the ground adjacent the left-hand end of that elongated container; and pivots 36 secure that left-hand end to those supports. As a result, that elongated container can have the right-hand end thereof moved up or down to establish a desired inclination of that elongated container relative to the horizontal. Leg-like supports 38 extend upwardly from the ground adjacent the right-hand end of the elongated container 32; and a rod-like support 40 can be removably positioned within holes 41 in the upper ends of those supports to underlie and hold that right-hand end at a desired level.

Figure 2:
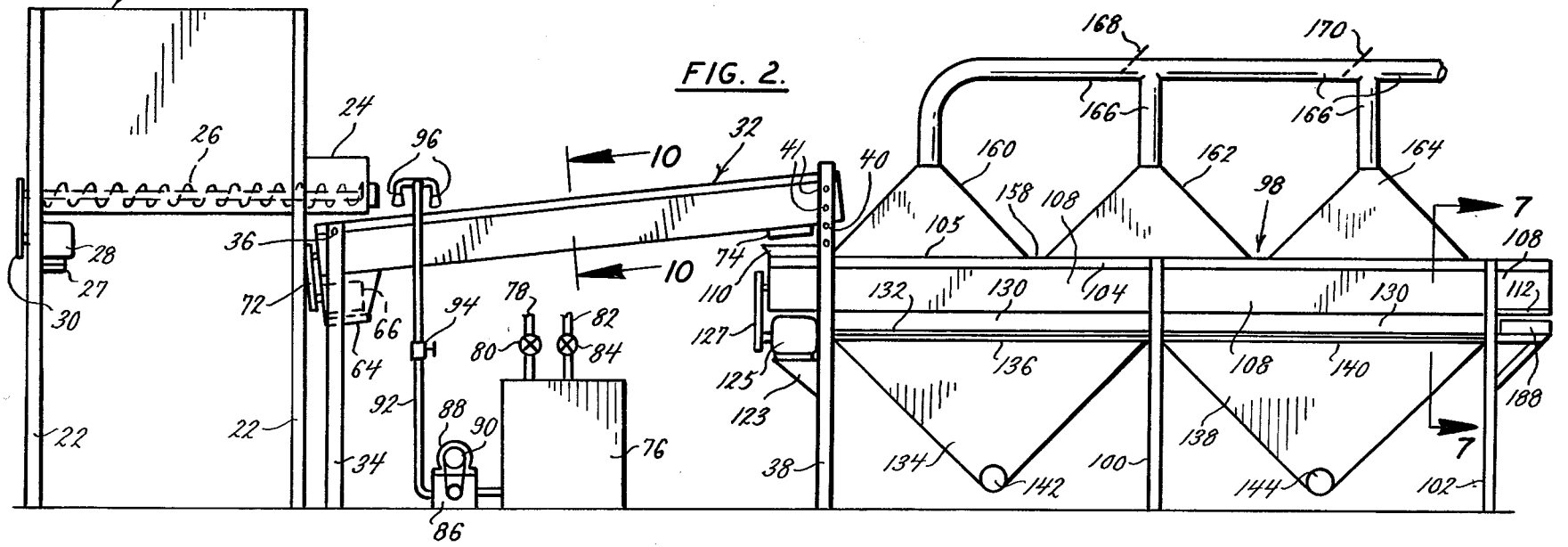
FIG. 2 is a side elevational view of the lint removing apparatus shown in FIG. 1.

FIG. 2 shows the elongated container 32 disposed at an angle of about seven degrees to the horizontal, and with the right-hand end thereof disposed above the level of the left-hand end thereof. However, if desired, the lint-removing apparatus of FIG. 1 could be dimensioned so that elongated container was horizontal or was at any angle between the horizontal and fifteen degrees above the horizontal.

Figure 10:
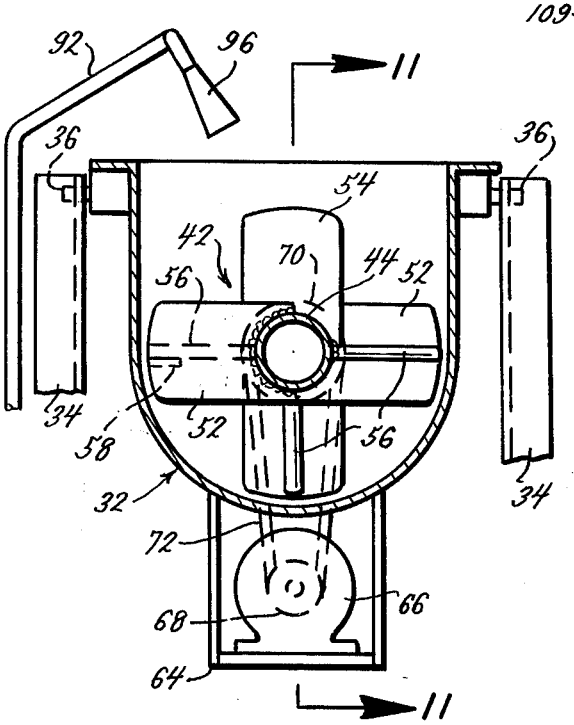
FIG. 10 is a sectional view, on the scale of FIG. 7, through the acid-treating portion of the lint-removing apparatus of FIG. 1, and it is taken along the plane indicated by the line 10—10 in FIG. 2.

The numeral 42 generally denotes a seed stirring and moving member which has an elongated shaft 44 that is supported by bearings 46 and 48 at the ends of the elongated container 32 and also by a bearing within a hanger 50. That shaft could be made in different ways; but it is shown as being made of two hollow portions that are interconnected by an intermediate cylindrical stub shaft and that have cylindrical stub shafts projecting from the ends thereof to be held by the bearings 46 and 48. Blades 52 are welded or otherwise secured to the tubular portions of the seed stirring and moving member 42; and those blades are inclined or curved relative to the axis of that member, as shown by FIG. 11. As a result, those blades will respond to rotation of that shaft 44 in the counter clockwise direction in FIG. 10 to cause lint-bearing cotton seeds in the elongated container 32 to move toward the right-hand end of that elongated container. Further blades 54 are welded or otherwise secured to the tubular portions of the seed stirring and moving member 42 so they are perpendicular to the axis of that member. In addition, rods 56 of circular cross section are welded or otherwise secured to the tubular portions of that seed stirring and moving member. The blades 54 and the rods 56 will respond to rotation of the seed stirring and moving member 42 to recurrently pass downwardly, laterally and upwardly through lint-bearing cotton seeds in the elongated container 32; but they will not cause those lint-bearing cotton seeds to advance toward the right-hand end of the elongated container 32. Instead, those blades and rods will stir those lint-bearing cotton seeds by recurrently parting, and then permitting the re-uniting of, those lint-bearing cotton seeds--with consequent application, and release, of compressive forces to those lint-bearing cotton seeds. The rods 56 are shown as being circular in cross section, and hence have non-directional convex leading faces. If desired, those rods could be made with non-directional convex leading faces even though they were not circular in cross section.

The numeral 58 denotes axially-extending bars which are secured to and hence are rotatable with the seed stirring and moving member 42. Those bars have flat faces which are generally radial with respect to the axis of that member; and those bars are secured to and supported by various of blades 52 and 54 and of rods 56. As indicated particularly by FIGS. 1, 10 and 11, the outer peripheries of those bars are parallel to, and are spaced about one-quarter of an inch from, the semi-cylindrical bottom of the elongated container 32. Those elongated bars will respond to rotation of the seed stirring and moving member 42 to move lint-bearing cotton seeds circumferentially within that elongated container. The outer peripheries of the blades 52 and 54 and of the rods 56 also are spaced about one-quarter of an inch from the semi-cylindrical bottom of the elongated container 32.

The numeral 60 denotes a deflector which is mounted within the right-hand end of the elongated container 32; and it has an opening 62 therein which accommodates the shaft 44. As shown particularly by FIG. 11, that deflector is inclined to the axis of that shaft and of the elongated container 32.

In a preferred embodiment of the present invention, the elongated container 32 has a length of about thirteen feet. The radius of the semi-cylindrical bottom of that elongated container is about 6 and ¾ inches; and the sides of that elongated container are planar and are parallel to each other. Outwardly extending stiffening flanges are provided at the upper edges of those planar sides. The angle between the axis of the elongated container 32 and the horizontal is about seven degrees.

The numeral 64 denotes a mounting bracket for an electric motor 66; and that bracket is secured to, and depends downwardly from, the left-hand end of the elongated container 32, as shown by FIGS. 2 and 11. That motor has a gear or pulley 68 mounted thereon; and that gear or pulley is in register with a gear or pulley 70 on the left-hand end of the shaft 44. A flexible drive 72, such as a chain or belt, interconnects the gears or pulleys 68 and 70, and hence enables energization of the motor 66 to rotate the seed stirring and moving member 42 in the counterclockwise direction in FIG. 10.

The numeral 74 denotes the outlet for the elongated container 32; and that outlet is adjacent the deflector 60 within the right-hand end of that elongated container, as shown by FIG. 11. The blades 52 on the seed stirring and moving member 42 will respond to rotation of that seed stirring and moving member to cause lint-bearing cotton seeds to move to and through the outlet 74.

The numeral 76 denotes a tank for dilute sulphuric acid; and a pipe 78 has the outlet thereof connected to that tank, and has the inlet thereof connected to a source, not shown, of commercial grade concentrated sulphuric acid. A valve 80 in pipe 78 determines the rate at which that concentrated sulphuric acid can enter the tank 76. The numeral 82 denotes a pipe which has the outlet end thereof connected to the tank 76, and which has the inlet thereof connected to a source of water. A valve 84 in that pipe determines the rate at which water can enter the tank 76. The numeral 86 denotes a pump which can draw dilute acid from the tank 76 and force that acid to pass upwardly through a pipe 92, a valve 94 in that pipe, and then out through spray nozzles 96. Those spray nozzles are located adjacent that end of the elongated container 32 into which lint-bearing cotton seeds fall from the enclosed outlet 24 of the bin 20. The setting of the valve 94 determines the rate at which the pump 86 can cause the dilute acid to be sprayed onto those lint-bearing cotton seeds by the spray nozzles 96. The numeral 88 denotes an electric motor which is shown mounted atop the pump 86; and the numeral 90 denotes a flexible drive, such as a chain or belt, which interconnects the shaft of that motor with the rotor of that pump.

The numeral 98 generally denotes an elongated container which has the left-hand end thereof underlying the right-hand end of the elongated container 32. The left-hand end of the elongated container 98 is held by the leg-like supports 38. The midpoint and the right-hand end of that elongated container are supported, respectively, by leg-like supports 100 and 102. The leg-like supports 38, 100 and 102 are shown holding the elongated container 98 so far above the ground that the elongated container 32 could not be set in a horizontal position. However, in any installation where it was desirable to have the elongated container 32 horizontal, the leg-like supports 38, 100 and 102 could be shortened and the leg-like supports 22 and 34 could be lengthened appropriately.

Figure 7:
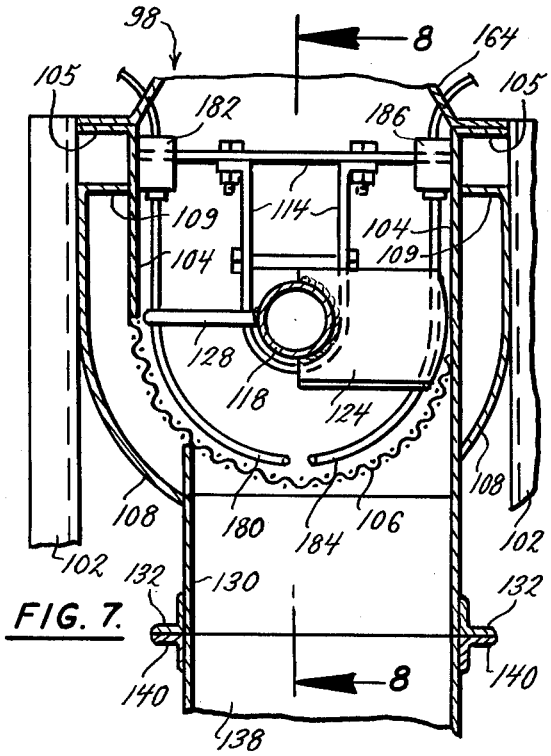
FIG. 7 is a sectional view, on a scale larger than that of FIG. 1, through the seed-drying portion of the lint-removing apparatus of FIG. 1, and it is taken along the plane indicated by the line 7—7 in FIG. 2.
Figure 8:
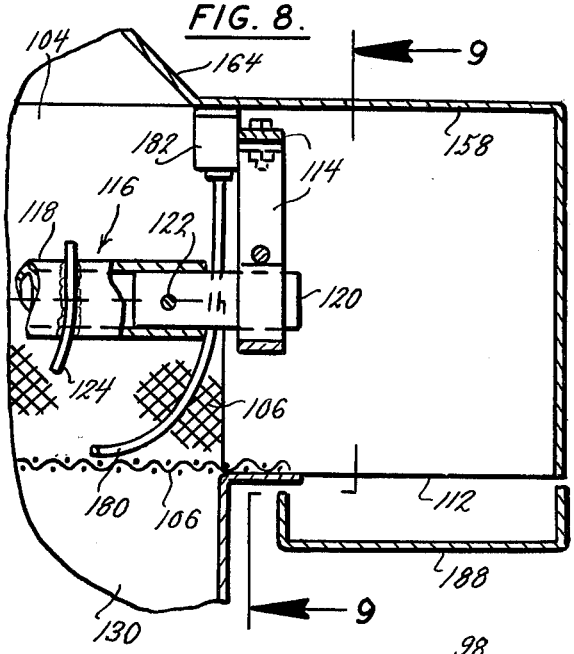
FIG. 8 is another sectional view, on the scale of FIG. 7, through the seed-drying portion of the lint-removing apparatus of FIG. 1, and it is taken along the plane indicated by the line 8—8 in FIG. 7.

The elongated container 98 has imperforate side walls 104 and a semi-cylindrical perforate bottom 106, as indicated particularly by FIGS. 7 and 8. Those side walls are planar and parallel; but stiffening flanges 105 are provided at the upper edges thereof. In the preferred embodiment of the present invention the radius of the semi-cylindrical bottom of that elongated container is about 6 and ¾ inches; and that bottom has round holes therein with diameters of three thirty-seconds of an inch. Such holes will readily pass air; but they will be too small to permit cotton seeds to pass through, or become stuck in, them. The perforate, semi-cylindrical bottom 106 has the edges thereof seam welded or otherwise secured to the lower edges of the side walls 104. The elonglated container 98 is about 20 feet long.

The numeral 108 denotes an elongated jacket with a generally semi-cylindrical bottom that has a larger radius than, but the same axis of generation as, the bottom 106 of the elongated container 98. That elongated jacket has planar side walls which are parallel to, but which are shorter in height than, the side walls 104 of the elongated container 98. The side walls of that jacket are disposed outwardly of the side walls 104 of that elongated container; but they are connected to them, at a point about four inches below the flanges 105, by inwardly-directed flanges 109. Those flanges are seam welded or otherwise secured to the side walls 104 of the elongated container 98. The jacket 108 is, effectively, an integral part of the elongated container 98; and it stiffens and strengthens that elongated container.

The numeral 110 denotes an inlet at the left-hand end of the elongated container 98; and that inlet is disposed directly below the outlet 74 of the elongated container 32, as shown particularly by FIGS. 2 and 11. The numeral 112 denotes an outlet for the elongated container 98; and that outlet is adjacent the right-hand end of that elongated container, as shown by FIGS. 2 and 8. The elongated container 32 is shown as having the axis thereof horizontal.

The numeral 114 denotes one of several hangers which are mounted within the elongated container 98 and which rotatably support the shaft 118 of a seed stirring and moving member which is generally denoted by the numeral 116. That shaft could be made in different ways; but it is shown as having tubular portions that are interconnected by cylindrical stub shafts and as having cylindrical stub shafts which project outwardly from the ends thereof. Thus, FIG. 8 shows a cylindrical stub shaft 120 which is secured to shaft 118 by a pin 122 and which extends outwardly from the right-hand end of that shaft to be held by a bearing in the adjacent hanger 114.

Figure 9:
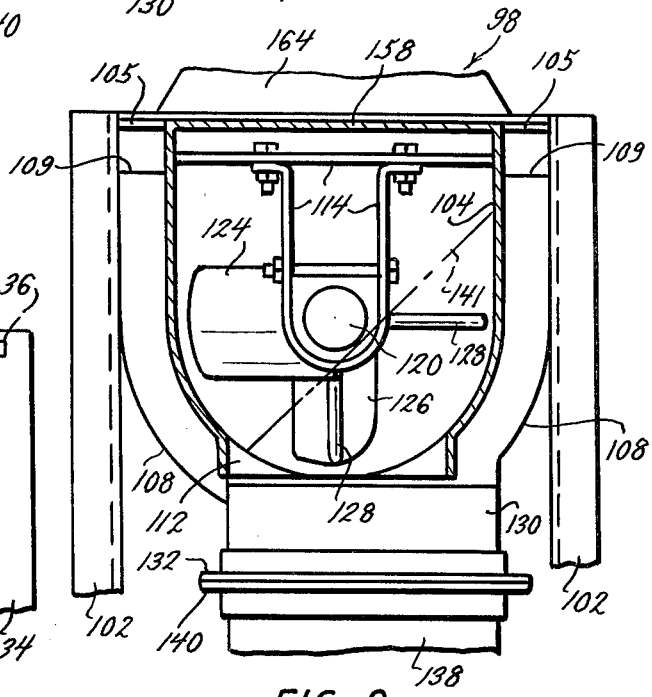
FIG. 9 is a further sectional view, on the scale of a FIG. 7, through the seed-drying portion of the lint-removing apparatus of FIG. 1, and it is taken along the broken plane indicated by the broken line 9—9 in FIG. 8.

The numeral 124 denotes a blade which is welded or otherwise secured to the shaft 118; and that blade is curved so it will respond to rotation of that shaft in the counter clockwise direction in FIG. 9 to cause acid-treated lint-bearing cotton seed to move to the right in the elongated container 98. The numeral 126 denotes a blade which is perpendicular to the axis of the shaft 118; and that blade will provide a stirring action rather than an advancing action as it is moved through the acid-treated lint-bearing cotton seed when that shaft rotates. The numeral 128 denotes a rod of circular cross section which is mounted on the shaft 118; and that rod also provides a stirring action rather than an advancing action when it is moved through the acid-treated lint-bearing cotton seed as that shaft rotates. The seed stirring and moving member 116 will, except for the length thereof, preferably be idential to the seed stirring and moving member 42 within the elongated container 32.

The numeral 123 denotes a mounting bracket which is secured to the leg-like supports 38, as shown by FIG. 2. An electric motor 125 is secured to that mounting bracket, and a flexible ddrive 127, such as a chain or belt, interconnects the rotor of that motor with the shaft 118 of the seed stirring and moving member 116. As a result, energization of that motor will cause rotation of that seed stirring and moving member in the counter clockwise direction in FIG. 10.

The numeral 130 denotes a duct-like support which has vertically-directed, planar parallel sides. The upper portion of one side pf that duct-like support extends upwardly through a cut-away portion of the bottom of jacket 108 to be secured to one of the side walls 104 of the elongated container 98, as shown by FIG. 7. The upper portion of the other side of that support extends upwardly through the cut-away portion of the bottom of the jacket 108 to abut the perforate bottom 106 of the elongated container 98. The upper portion of the one side of the duct-like support 130 will be suitably secured to the one side wall 104 by a seam weld or the like; and the upper portion of the other side of that duct-like support will be suitably secured to the perforate bottom 106 by a seam weld or the like. An angle-iron frame 132 is secured to, and extends around, the lower edge of the duct-like support 130. That duct-like support is slightly shorter that the overall lendth of the elongated container 98, as indicated by FIG. 2.

The numeral 134 denotes a pyramidal air collector which has the apex thereof at the bottom thereof and which has an angle-iron frame 136 secured to, and extending around, the larger upper end thereof. That angle-iron frame is secured to the angle-iron frame 132 of the duct-like support 130 by fasteners, not shown, such as bolts and nuts or machine screws. The numeral 138 denotes a second pyramidal air collector which has the apex thereof at the bottom end thereof and which has an angle-iron frame 140 secured to, and extending around, the larger upper end thereof. That angle-iron frame is secured to the angle-iron frame 132 of the duct-like support 130 by fasteners, not shown, such as bolts and nuts or machine screws. The pyramidal air collectors 134 and 138 fully close the bottom of the duct-like support 130, and they are securely held by that support.

The numeral 142 denotes an exhaust duct which is connected to the apex of the pyramidal air collector 134, and the numeral 144 denotes an exhaust duct which is connected to the apex of the pyramidal air collector 138. A Y-shaped duct fitting 146 is connected to the outer ends of the ducts 142 and 144; and a duct 147 extends from the outlet of that duct fitting to the inlet of a blower 149. The outlet of that blower is connected to the inlet of a cyclone separator 148. A filter 150 is connected to that outlet of the cyclone separator 148 through which any liquids or solids will pass; and that filter can be a gravel type filter of standard and usual design. The liquid outlet of that filter is connected to a tank 152 which will receive and hold any liquids which issue from that filter. The air outlet of the cyclone separator 148 is connected to the inlet of a scrubber 154 which will have an alkaline material, such as sodium hydroxide, therein. That scrubber will condense any steam and any acidic vapors, and also will neutralize any acidic vapors, which issue from the cyclone separator 148. Consequently, that scrubber will pass only clean air to the atmosphere via the exhaust 156 thereof.

The numeral 158 denotes a cover for the elongated container 98; and three pyramidal air directors 160, 162 and 164 are secured to, and extend upwardly from, that cover. Those pyramidal air directors are connected to three downwardly-extending arms of an air duct 166; and those pyramidal air directors will distribute air from that duct along the length of the elongated container 98. Slide dampers 168 and 170 are provided for the air duct 166; and those slide dampers will be adjusted to provide an appropriate distribution of air from that air duct to the elongated container 98. The numeral 172 denotes a blower which has the outlet thereof connected to the inlet of the air duct 166. The inlet of that blower is connected to a heater 178 which can be gas-fired, can be oil-fired, can be equipped with an electric heater, or can utilize any other suitable source of heat. The numeral 174 denotes an electric motor; and the numeral 176 denotes a flexible coupling, such as a belt or chain, which connects the rotor of that motor to the rotor of blower 172.

The numeral 180 denotes a temperature-sensing device which is mounted within the elongated container 98 adjacent the outlet 112 of that elongated container. That temperature-sensing device is shown as having an elongated tubular portion which is filled with a temperature-sensitive fluid and as having a housing 182. That tubular portion is given a curvature which enables it to generally conform to the inner surface of the elongated container 98. Also, as shown particularly by FIG. 8, that long tubular portion has a generally-helical configuration which is intended to conform to the path of movement of acid-treated lint-bearing cotton seeds as they are moved through the right-hand portion of the leongated container 98. The housing 182 of the temperature-sensing element is secured to the hanger 114. The numeral 184 denotes a similar temperature-sensing device which has the housing 186 thereof mounted on that same hanger. As shown particularly by FIG. 7, the temperature-sensing devices 180 and 184 are disposed at opposite sides of the elongated container 98; and, as indicated by FIG. 8, the long tubular portion of each of those temperature-sensing devices has a helical configuration which is intended to conform to the path of movement of acid-treated lint-bearing cotton seeds that approach the discharge 112 of elongated container 98.

The numeral 188 denotes a conveyor which underlies the discharge 112 of the elongated container 98, and which extends to the inlet 192 of a lint-removing unit which is generally denoted by the numeral 190. That conveyor preferably is a vibratory conveyor which will cause dried acid-treated lint-bearing cotton seeds that issue from the outlet 112 to move directly to the inlet 192. The lint-removing unit 190 has an outlet 194 which is displaced from the inlet 192 by number of chambers 196, 198, 200 and 202 and also by a chamber 255. Each of the chambers 196, 198, 200 and 202 has a semi-cylindrical bottom; and side walls 207 and 209 effectively close the ends of those chambers. Leg-like supports 201 space the lint-removing unit 190 above the ground; but they are short enough to dispose the inlet 192 at a level which enables dried acid-treated lint-bearing cotton seed to flow from the conveyor 188 into that inlet.

Vertically directed slots 203 are provided in the side walls 207 and 209, as indicated by FIGS. 3 and 5; and those slots accommodate the side edges of vertically-adjustable partitions 204, 206 and 208. The numeral 210 denotes an upwardly-extending and flanged portion of the bottom of the chamber 202; and that portion serves as a fixed partition.

Angle brackets 212 are secured to the side edges of the movable partition 204; and similar angle brackets, not shown, are secured to the side edges of the movable partitions 206 and 208. Sets of angle brackets 214 are secured to the lower portions of the side walls 207 and 209 in register with the angle brackets 212 on the movable partitions 204, 206 and 208. Threaded rods 216 extend upwardly from the angle brackets 214 to extend through openings in the angle brackets 212. Nuts 220 are threaded on the threaded rods 216 to underlie the angle brackets 212, and those nuts will be set to hold the adjustable partitions 204, 206 and 208 at desired heights. Further nuts 218 are threaded onto the threaded rods 216 to overlie the angle brackets 212; and those nuts will hold the angle brackets 212 in engagement with the nuts 220. Appropriate settings of the nuts 218 and 220 can dispose the upper edge of any of the movable partitions 204, 206 and 208 at any desired position relative to the upper edge of the lint-removing unit 190.

The numerals 222, 224, 226 and 228 denote seed-moving reels which are mounted, respectively, within the chambers 196, 198, 200 and 202 of the lint-removing unit 190. Each of those reels has a rotatable shaft with a four-armed spider at each end thereof, and has elongated flat seed-moving bars 230 secured to the outer ends of those arms. Elongated wiper blades 232 of acid-resistant synthetic rubber are secured to the elongated flat seed-moving bars 230 by rivets 234. The outermost edges of the seed-moving bars 230 are spaced about one quarter of an inch inwardly of the semi-cylindrical bottoms of the chambers 196, 198, 200 and 202; but the outermost edges of the wiper blades 232 engage and rub against those semi-cylindrical bottoms.

The numeral 236 denotes a cover for the lint-removing unit 190; and, as shown particularly by FIGS. 3–5, that cover is essentially flat. The wiper blades 232 engage and rub against the under face of that cover. The cover 236 extends from the inlet 192 to a point above the upwardly-extending and flanged portion 210 of the bottom of the chamber 202.

In the one preferred embodiment of the present invention, each of the chambers 196, 198, 200 and 202 is 20 inches wide, 20 inches high, and 48 inches long. Each of the partitions 204, 206, and 208 can be moved from a position wherein the top thereof is 2 inches below the surface of the cover 236 to a position wherein that top is 10 inches below that under surface. The distances between the tops of those partitions and the under surface of that cover will determine the average length of time a dried acid-treated lint-bearing cotton seed will remain in each of the chambers 196, 198, 200 and 202, and hence will determine the average length of time that dried acid-treated lint-bearing cotton seed will remain in the lint-removing unit 190.

The chamber 255 has a pyramidal air collector 260 at the top thereof; and that pyramidal air collector abuts the left-hand end of the cover 236, as that cover is viewed in FIG. 3. The apex of that pyramidal air collector extends upwardly, and the large area bottom of that pyramidal air collector is secured to the side walls 207 and 209 of the lint-removing unit 190. An exhaust opening 258 at the top of the pyramidal air collector 260 is connected to a blower, now shown, which is connected to a cyclone separator, not shown. A perforate plate or screen 256 extends from the top of the upwardly-extending and flanged portion 210 of the bottom of the chamber 202 to the outlet 194. As shown by FIG. 3, that perforate plate or screen inclines downwardly from that top to that outlet; and hence cotton seeds which pass over that top will roll downwardly to that outlet.

The numerals 238, 240, 242 and 244 denote gear boxes which are mounted adjacent the side wall 209 of the lint-removing unit 190. Short shafts 246, 248 and 250 interconnect gears within the gear boxes 238, 240, 242 and 244 so all of the seed-moving reels 222, 224, 226, 228 will rotate in the clockwise direction in FIG. 3 at the same rate. The numeral 252 denotes an electric motor which is mounted on the lint-removing unit 190; and the numeral 254 denotes a flexible drive, such as a chain or belt, which interconnects the rotor of the motor 252 with one of the gears in the gear box 238.

The numeral 262 denotes a bin which is located adjacent the outlet 194 of the lint-removing unit 190. The cotton seeds which enter that bin from that outlet have, in the one preferred embodiment of the present invention, either no lint or lint to the extent of less than one-quarter of one percent of the weight of those cotton seeds.

With the exception of the wiper blades 232, most of the components of the lint removing apparatus of the present invention will be made from a metal which is resistant to sulphuric acid. One such metal is marketed under the trademark Monel, but other suitable acid-resistant metals could be used.

In the operation of the lint removing apparatus provided by the present invention, lint-bearing cotton seed will be introduced into the bin 20 in the form of loads or batches. However, that lint-bearing cotton seed will be supplied to the elongated container 32 by the auger 26 on a continuous, rather than on a batch, basis. Similarly, the seed stirring and moving member 42 in that elongated container will supply acid-treated lint-bearing cotton seed to the elongated container 98 on a continuous, rather than on a batch, basis; and the seed stirring and moving member 116 in the latter elongated container will supply dried acid-treated lint-bearing cotton seed to the conveyor 188 on a continuous, rather than on a batch, basis. The lint-removing unit 190 will receive the dried acid-treated lint-bearing cotton seed from that conveyor on a continuous, rather than on a batch, basis, and it will deliver lint-free cotton seed to the bin 262 on a continuous, rather than on a batch, basis.

The amount of lint on ginned cotton seeds can vary considerably — constituting as little as 12 percent of the weight of the ginned cotton seeds or constituting as much as 20 percent of the weight of those ginned cotton seeds. Each load or batch of lint-bearing cotton seeds which is to be introduced into the bin 20 should be evaluated to determine what percent of the weight thereof is lint. Thereafter, the valves 80 and 84 should be set to provide a concentration of sulphuric scid which is comparable to the percent of weight of lint in that load or batch. Specifically, where the lint in any given load or batch of ginned cotton seeds is 12 percent of the weight of that load or batch, the valves 80 and 84 should be set to make the dilute sulphuric acid within the tank 76 have 12 parts of concentrated sulphuric acid and 88 parts of water. On the other hand, where the lint in any given load or batch of ginned cotton seeds is 20 percent of the weight of that load or batch, the valves 80 and 84 should be set to make the dilute sulphuric acid within the tank 76 have 20 parts of concentrated sulphuric acid and 80 parts of water.

The valve 94 should be set to cause the nozzles 96 to spray the dilute acid onto the lint-bearing cotton seeds in the elongated container 32 at a rate which will make the weight of that dilute acid 10 percent to 35 percent of the weight of the lint on those lint-bearing cotton seeds. For example, if lint-bearing cotton seeds are moved past the nozzles 96 at the rate of 2,000 pounds of lint per unit of time, the valve 94 should be set to cause those nozzles to spray 200 to 700 pounds of dilute acid onto those lint-bearing cotton seeds during that unit of time.

In the one preferred embodiment of the present invention, the concentration of the sulphuric acid is made the same as the percent of weight of lint in each load or batch of lint-bearing cotton seeds. Further, the valve 94 is set to cause the nozzles 96 to spray the resulting dilute acid onto the lint-bearing cotton seeds in the elongated container 32 at a rate which makes the weight of that acid between 13 and 15 percent of the weight of the lint on those lint-bearing cotton seeds. For example, if it were to be assumed that 14 percent of the weight of a given 2,000 pound load or batch of lint-bearing cotton seeds was lint, the valves 80 and 84 would be set to make the composition of the dilute acid in tank 76 14 parts of commercial concentrated sulphuric acid and 86 parts of water; and the valve 94 would be set to cause the nozzles 96 to spray 280 pounds of that dilute acid onto each batch of those lint-bearing cotton seeds which includes 2,000 pounds of lint.

The motors 66 and 125 can be constant speed motors or they can be controlled-speed motors. In either event, the motor 125 will rotate the seed stirring and moving member 116 so it advances the acid-treated lint-bearing cotton seeds at a rate which is at least equal to the rate at which the motor 66 causes the seed stirring and moving member 42 to advance the lint-bearing cotton seeds. The motor 28 will supply lint-bearing cotton seeds to the elongated container 32 at the same rate at which that elongated container delivers acid-treated lint-bearing cotton seeds to the discharge 74 thereof.

The blades 54 and the rods 56 on the seed stirring and moving member 42 will respond to rotation of that member to recurrently move downwardly toward the bottom of the elongated container 32 and then upwardly toward the top of that elongated container. As those blades and rods do so, they will part the lint-bearing cotton seeds which are immediately ahead of them, and then will let those lint-bearing cotton seeds re-unite immediately behind them--with a consequent application and release of compressive forces to those lint-bearing cotton seeds. Also, the parting and reuniting of the lint-bearing cotton seeds causes relative movement between those lint-bearing cotton seeds and the acid which was applied to those lint-bearing cotton seeds as they were moved past the nozzles 96. In addition, the blades 54 and the rods 56 will tend to cause the lint-bearing cotton seeds to rise upwardly along the right-hand side wall of the elongated container 32, as that elongated container is viewed in FIG. 10, and then roll downwardly toward the left-hand side wall. The elongated bars 58 on the seed stirring and moving member 42 will recurrently move downwardly toward the bottom, and then upwardly toward the top, of the elongated container 32; and, in doing so, will move some of the lint-bearing cotton seeds circumferentially of that elongated container and will cause those lint-bearing cotton seeds to rise upwardly along the right-hand side wall of the elongated container 32, as that elongated container is viewed in FIG. 10, and then roll downwardly toward the left-hand side wall. In addition, those elongated bars will compress the lint on the lint-bearing cotton seeds immediately in front of them, and then will permit the lint on the lint-bearing cotton seeds immediately behind them to expand; and also will cause relative movement between lint-bearing cotton seeds which are immediately adjacent the paths of those elongated bars. All of this means that the blades 52, the rods 56 and the elongated bars 58 will provide a prompt and thorough admixing of the lint-bearing cotton seeds with the acid that was sprayed onto them.

The blades 52 also will part, and then permit re-uniting of, the lint-bearing cotton seeds as those blades are recurrently moved through the lint-bearing cotton seeds. Consequently, the latter blades will provide a mixing action between the acid and the lint-bearing cotton seeds as they apply axially directed advancing force to those lint-bearing cotton seeds. That mixing action will add to the mixing action provided by the blades 54, the rods 56 and the elongated bars 58.

The combined mixing actions of the blades 52 and 54, of the rods 56, and of the elongated bars 58 make certain that the acid and the lint-bearing cotton seeds will be admixed so promptly and so thoroughly that all of the acid will have been absorbed, and that all of the lint on those lint-bearing cotton seeds will have become saturated with acid, by the time those lint-bearing cotton seeds reach the outlet 74. Even in those instances where the elongated container 32 has been set so its axis was horizontal, all of the acid was absorbed, and all of the lint was saturated, prior to the time the lint-bearing cotton seeds reached the outlet 74. Consequently, no acid drained out, or was forced out, of that outlet in the form of free liquid. As the acid-treated lint-bearing cotton seeds approach the outlet 74, the deflector 60 will help cause those lint-bearing cotton seeds to move downwardly through that outlet and into the inlet 110 of the elongated container 98.

The blades 124 and 126, the rods 128, and further blades and elongated bars, not shown, of the seed stirring and moving member 116 will continuously stir the acid-treated cotton-bearing seeds in the elongated container 98 as that member moves those acid-treated lint-bearing cotton seeds toward the outlet 112 of that elongated container. Also, those blades, rods and elongated bars will cause the acid-treated lint-bearing cotton seeds to rise upwardly along the right-hand side wall of the elongated container 98, as indicated by the dotted line 141 in FIG. 9, and then fall downwardly toward the left-hand side wall. The resulting stirring and rolling of those acid-treated lint-bearing cotton seeds, and the advancement of those acid-treated lint-bearing cotton seeds at a rate which is at least equal to, and which preferably is faster than, the rate at which they were advanced in the elongated container 32, facilitates the passage of heated air downwardly through those acid-treated lint-bearing cotton seeds. That heated air receives its heat from the heater 178; and it is forced to move through the air duct 166 by the blower 172. In the one preferred embodiment of the present invention, the blower 172 establishes a positive air pressure in the range of 8 to 12 inches of water. Simultaneously, the blower 149 establishes a negative pressure in the pyramidal air collectors 134 and 138 of about 14 inches of water. Sufficient heat is supplied to the air by the heater 178 to enable that air to cause the temperature of the acid-treated lint-bearing cotton seeds to closely approach 138° Fahrenheit as those acid-treated lint-bearing cotton seeds reach the outlet 112. None of the acid-treated lint-bearing cotton seeds will have the temperature thereof reach 140° Fahrenheit; because, if the temperature of any acid-treated lint-bearing cotton seeds in contact with either of the temperature sensing devices 180 and 184 tended to reach 140° Fahrenheit, that temperature sensing device would act to reduce the heat that the heater 178 supplies to the air moved by the blower 172. Those temperature sensing devices could reduce that heat by causing that heater to temporarily stop supplying further heat, by reducing the rate at which that heater supplied heat, or by any of the other ways customarily used in the art of air-heating devices.

The heated air which passes downwardly through the acid-treated, lint-bearing cotton seeds will convert most of the water, which was added by the pipe 82, to vapor form; and that vaporized water will pass downwardly to and through the pyramidal air collecters 134 and 138. That vaporized water, and any entrained acid vapors, will largely condense in the cyclone separator 148. If necessary, in hot climates, that cyclone separator could be cooled to facilitate the condensing therein of the vaporized water and entrained acid vapors which are introduced into it by the blower 149.

The liquids, and any solid materials which collect in the cyclone separator 148 will pass to the filter 150. The gravel in that filter will remove any solid material from the condensed water and acid. That condensed water and acid then will drain into a tank 152; and that tank could, if desired, be a part of the tank 76. Alternatively, the tank 152 could be connected to the tank 76 by a valved pipe. Any uncondensed water vapor which issued from the cyclone separator 148 would be condensed as it passed through an alkaline solution within the scrubber 154; and any acid vapors that were entrained in that vapor would be neutralized as it passed through that alkaline solution. Consequently, essentially clean air would issue from the lint on the scrubber 154 to the atmosphere via the exhaust 156.

At the time the acid-treated lint-bearing cotton seed issues from the outlet 74 of the elongated container 32, it is in a damp-dry state. Specifically, where the weight of dilute acid, which is added to the lint-bearing cotton seed, is in the range of 13 to 15 percent of the weight of the lint-bearing cotton seeds, it is not possible for a person to use his hand to compress the acid-treated lint-bearing cotton seed and cause any drops of acid to be exuded therefrom. As the dried acid-treated lint-bearing cotton seeds issue from the outlet 112 of the elongated container 98, they are completely or substantially completely dry. Moreover, the lint on the acid-treated lint-bearing cotton seeds has lost its natural resiliency.

The vibratory conveyor 188 will cause the dried acid-treated lint-bearing cotton seeds to move into the inlet 192 of the lint-removing unit 190. As those dried acid-treated lint-bearing cotton seeds pass inwardly through that inlet, the elongated seed-moving bars 230 on the reel 222 will move those dried acid-treated lint-bearing cotton seeds away from that inlet at a rate which is at least equal to, and which preferably is faster than, the rate at which they were advanced in the elongated container 98. Those elongated seed-moving bars will force those dried acid-treated lint-bearing cotton seeds downwardly toward the bottom of the chamber 196, and then will move those dried acid-treated lint-bearing cotton seeds upwardly toward the top of that chamber. As those bars move those dried acid-treated lint-bearing cotton seeds downwardly toward the bottom of that chamber, they will move those dried, acid-treated lint-bearing cotton seeds into and through a dense mass of cotton seeds; and, as those bars move those dried acid-treated lint-bearing cotton seeds upwardly toward the top of that chamber, they will move those dried, acid-treated lint-bearing cotton seeds into and through a less dense mass of cotton seeds. Also, as the elongated bars 230 of the reel 222 move downwardly and then upwardly, they will bodily shift and displace some of the cotton seeds within the chamber 196, and will thereby enforce relative movement between various of the cotton seeds within that chamber. Each dried, acid-treated, lint-bearing cotton seed which enters the inlet 192 will be forced to contact, and move relative to, many other cotton seeds before it eventually works its way to and over the top of the adjustable partition 208 and then enters the chamber 198.

As each cotton seed moves to and over the top of the partition 208, it will be moving upwardly or horizontally; and it will immediately be forced to change direction, and to start moving downwardly, by the next-succeeding elongated bar 230 on the reel 224. In being moved downwardly, and then in subsequently being moved upwardly, through the chamber 198, each cotton seed will be forced to move into and through a dense mass of cotton seeds and then will be permitted to enter a less dense mass of cotton seeds. Further, as the elongated bars 230 on the reel 224 recurrently pass downwardly and then move upwardly through the cotton seeds in the chamber 198, they will bodily shift and displace some of the cotton seeds within that chamber and will thereby cause relative movement between many of the cotton seeds in that chamber.

The cotton seeds which rise to and pass over the top of the partition 206 will successively pass into and through the chambers 200 and 202. In each of those chambers they will initially be forced to change direction and to start moving downwardly toward the bottom of that chamber. Moreover, in each of those chambers, each seed will be forced to rub against and to contact many other seeds before it can rise upwardly to the outlet of that chamber. As a result, by the time each dried, acid-treated, lint-bearing cotton seed has passed through each of the chambers 196, 198, 200 and 202, and has risen to and passed over the upper portion 210 of the bottom of chamber 202, it will have had all or essentially all of the lint mechanically separated therefrom. Consequently, as the cotton seeds roll downwardly over the surface of the perforated plate 256 in chamber 255, the air which moves upwardly through that plate and then out through the outlet 258 of that chamber will carry away the lint. That lint will have the form of a fibrous dust, and hence will easily separate from the cotton seeds which will roll down over the perforated plate 256 and enter the bin 262 through the outlet 194 of the lint-removing unit 190. The air and the entrained lint which pass upwardly through the outlet 258 will be passed through a further cyclone separator, not shown, where the entrained lint will be removed. In the one preferred embodiment of the present invention, the cotton seeds which pass into the bin 262 through the outlet 194 of the lint-removing unit 190 will either be completely devoid of lint or will have less than one quarter of one percent lint thereon.

The number of times the average cotton seed is caused to engage and rub against other cotton seeds in the various chambers of the lint-removing unit 190 is a function of the vertical positions of the partitions 204, 206 and 208. The closer the tops of those partitions are set to the under surface of the cover 236, the greater will be the number of times the average cotton seed is caused to engage and rub against other cotton seeds in the various chambers of the lint-removing unit 190.

The de-linted cotton seeds which enter the bin 262 will be passed through a neutralizing solution to neutralize the dried acid thereon. Also, those de-linted cotton seeds will be passed through cleaning units to remove any twigs, bolls or other foreign matter. After the neutralizing step, the cleaning step, and any other desired step, the de-linted cotton seeds will be placed in bags.

The one preferred embodiment of seed treating apparatus provided by the present invention is able to use a ratio, of dilute sulphuric acid to the lint on lint-bearing cotton seeds, as low as 13 to 15 percent only because the seed stirring and moving member 42 provides a thorough admixing of that acid and of those lint-bearing cotton seeds. That range compensates for the differences in weight of the dilute acid which stem from the matching of the concentration of the sulphuric acid to the percent of weight of lint in each given load or batch of lint-bearing cotton seeds.

The apparatus provided by the present invention removes lint from lint-bearing cotton seeds quickly, effectively, economically and with no impairment of the germination capabilities of those cotton seeds. Further, that apparatus removes that lint on a continuous basis rather than on a batch basis.

Whereas the drawing and accompanying description have shown and described one preferred embodiment of the present invention it should be apparent to those skilled in the art that various changes may be made in the form of the invention without affecting the scope thereof.

What I claim is:

1. Apparatus which comprises a first elongated container, a second elongated container, a third container, a source of lint-bearing cotton seeds which can supply lint-bearing cotton seeds to said first elongated container on a continuous rather than on a batch basis, said lint-bearing cotton seeds being supplied to said first elongated container adjacent one end thereof, a source of acid which can supply aicd to said first-elongated container on a continuous rather than on a batch basis, said acid being supplied to said first elongated container adjacent said one end thereof, a seed stirring and moving member which can admix said acid with said lint-bearing cotton seeds in said first elongated container while it moves said lint-bearing cotton seeds toward the opposite end of said first elongated container, said first elongated container having an outlet adjacent said opposite end thereof through which acid-treated cotton seeds can pass on a continuous rather than on a batch basis, said second elongated container being disposed to receive said acid-treated cotton seeds adjacent one end thereof on a continuous rather than on a batch basis, a second seed stirring and moving member which can stir said acid-treated cotton seeds in said second elongated container while it moves said acid-treated cotton seeds toward the opposite end of said second elongated container, a blower which moves heated air into and through said second elongated container to dry said acid-treated cotton seeds while said second seed stirring and moving member is stirring and moving said acid-treated cotton seeds toward said opposite end of said second elongated container, said second elongated container having an outlet adjacent said opposite end thereof through which dried acid-treated cotton seeds can pass on a continuous rather than on a batch basis, said third container having an inlet which can receive said dried acid-treated cotton seeds on a continuous rather than on a batch basis, and a seed-moving member which forces said dried acid-treated cotton seeds downwardly toward the bottom of said third container, and hence into a dense mass of cotton seeds, and thereafter moves said dried acid-treated cotton seeds upwardly toward the top of said third container, and hence toward a less dense mass of cotton seeds, the movement of said dried acid-treated cotton seeds downwardly into said dense mass of cotton seeds causing said dried acid-treated cotton seeds to rub against other cotton seeds and thereby mechanically free said dried acid-treated cotton seeds of lint thereon.

2. Apparatus as claimed in claim 1 wherein said second seed stirring and moving member moves said acid-treated cotton seeds in said second elongated container away from said one end of said second elongated container at a rate which is at least equal to the rate at which the first said seed stirring and moving member moves acid-treated cotton seeds in said first elongated container toward said outlet of said first elongated container.

3. Apparatus as claimed in claim 1 wherein said seed-moving member moves said dried acid-treated cotton seeds in said third container away from said inlet of said third container at a rate which is at least equal to the rate at which said second seed stirring and moving member moves said acid-treated cotton seed in said second elongated container toward said outlet of said second elongated container.

4. Apparatus as claimed in claim 1 wherein said one end of said second elongated container is located below and in register with said outlet of said first elongated container, whereby said acid-treated cotton seeds pass directly by gravity flow from said first elongated container into said second elongated container, and wherein said second seed stirring and moving member moves said acid-treated cotton seeds in said second elongated container away from said one end of said second elongated container at a rate which is at least equal to the rate at which the first said seed stirring and moving member moves acid-treated cotton seeds in said first elongated container toward said outlet of said first elongated container.

5. Apparatus which comprises an elongated container that can receive and hold lint-bearing cotton seeds to which acid is to be applied, an inlet for acid adjacent one end of said elongated container, an outlet for acid-treated cotton seeds adjacent the opposite end of said elongated container, a seed moving and stirring member which can admix said acid with said lint-bearing cotton seeds in said elongated container while it moves said lint-bearing cotton seeds toward said outlet of said elongated container, and means to determine the rate at which said acid is introduced into said elongated container, said means causing said acid to enter said elongated container at a rate which coacts with the rate at which said seed stirring and moving member moves said lint-bearing cotton seeds toward said outlet of said elongated container to enable the lint on said lint-bearing cotton seeds to become saturated while enabling said acid-treated cotton seeds to remain damp-dry.

6. Apparatus as claimed in claim 5 wherein said elongated container is generally horizontal and wherein said outlet of said elongated container is open during the operation of said apparatus but wherein said lint on said lint-bearing cotton seeds absorbs said acid before said acid-treated cotton seeds can reach said outlet of said elongated container, whereby no acid will be able to flow to and through said outlet of said elongated container during the operation of said apparatus.

7. Apparatus as claimed in claim 5 wherein said seed moving and stirring member repeatedly applies and releases compressive forces to some of said lint-bearing cotton seeds and also moves other said lint-bearing cotton seeds circumferentially of said elongated container while moving said lint-bearing cotton seeds toward said outlet of said elongated container, and wherein said repeated application and release of said compressive forces and said circumferential movement facilitate absorption of said acid by said lint on said lint-bearing cotton seeds.

8. Apparatus which comprises an elongated container that can receive and hold acid and lint-bearing cotton seeds, a seed stirring and moving member, supports for said seed stirring and moving member which enable said seed stirring and moving member to rotate relative to said elongated container, a plurality of elements on said seed stirring and moving member which are inclined to the axis of said elongated container and which respond to rotation of said seed stirring and moving member to move said lint-bearing cotton seeds axially of said elongated container, and further elements on said seed stirring and moving member which extend outwardly from said seed stirring and moving member and which respond to rotation of said seed stirring and moving member to recurrently pass downwardly and then upwardly through said lint-bearing cotton seeds, said further elements having essentially-continuous convex surfaces so they can recurrently pass downwardly and then upwardly through said lint-bearing cotton seeds without applying substantial axially-directed forces to said lint-bearing cotton seeds, said further elements recurrently applying and releasing compressive forces to said lint-bearing cotton seeds as they recurrently pass downwardly and then upwardly through said lint-bearing cotton seeds, said recurrent application and release of said compressive forces facilitating absorption of said acid by the lint on said lint-bearing cotton seeds.

9. Apparatus as claimed in claim 8 wherein additional elements on said seed stirring and moving member are adjacent the inner surface of said elongated container, wherein said additional elements extend generally axially of said elongated container and respond to rotation of said seed stirring and moving member to recurrently pass downwardly and then upwardly through sid lint-bearing cotton seeds, and wherein said additional members force some of said lint-bearing cotton seeds to move downwardly toward and then upwardly away from the bottom of said elongated container.

10. Apparatus as claimed in claim 8 wherein additional elements on said seed stirring and moving member are adjacent the inner surface of said elongated container, wherein said additional elements extend generally axially of said elongated container and respond to rotation of said seed stirring and moving member to recurrently pass downwardly and then upwardly through said lint-bearing cotton seeds, wherein said additional members force some of said lint-bearing cotton seeds to move downwardly toward and then upwardly away from the bottom of said elongated container, and wherein said additional elements have generally-flat faces that are displaced radially outwardly from the axis of rotation of said seed stirring and moving member.

11. Apparatus which comprises an elongated container that can receive and hold acid and lint-bearing cotton seeds, a seed stirring and moving member, supports for said seed stirring and moving member which enable said seed stirring and moving member to rotate relative to said elongated container, a plurality of elements on said seed stirring and moving member which are inclined to the axis of said elongated container and which respond to rotation of said seed stirring and moving member to move said lint-bearing cotton seeds axially of said elongated container, and additional elements of said seed stirring and moving member that are adjacent the inner surface of said elongated container, said additional elements extending generally axially of said elongated container and responding to rotation of said seed stirring and moving member to recently pass downwardly and then upwardly through said lint-bearing cotton seeds, said additional elements forcing some of said lint-bearing cotton seeds to move downwardly toward and then upwardly away from the bottom of said elongated container.

12. Apparatus as claimed in claim 11 wherein said additional elements have generally-flat faces that are displaced radially outwardly from the axis of rotation of said seed stirring and moving member.

13. Apparatus which comprises an elongated container that can receive and hold lint-bearing cotton seeds to which acid is to be applied, an inlet that admits acid into said elongated container, an outlet for acid-treated cotton seeds which permits acid-treated cotton seeds to issue from said elongated container, a seed moving and stirring member which can admix said acid with said lint-bearing cotton seeds in said elongated container while it moves said lint-bearing cotton seeds toward said outlet of said elongated container, and means to determine the rate at which said acid is introduced into said elongated container, said means causing said inlet to introduce said acid into said elongated container at a rate which coacts with the rate at which said seed stirring and moving member moves said lint-bearing cotton seeds toward said outlet of said elongated container to make the amount of acid which is added to said lint-bearing cotton seeds be 10 percent to 35 percent of the weight of the lint on said lint-bearing cotton seeds, said acid permitting said lint to remain on said lint-bearing cotton seeds but destroying the natural resilience of said lint.

14. Apparatus which comprises an elongated container that can receive and hold acid and lint-bearing cotton seeds, a seed stirring member, supports for said seed stirring member which enable said seed stirring member to rotate relative to said elongated container, a source of power to rotate said seed stirring member relative to said elongated container, a plurality of elements on said seed stirring member which extend outwardly from said seed stirring member and which respond to rotation of said seed stirring member to recurrently pass downwardly and then upwardly through said lint-bearing cotton seeds, said elements having essentially continuous convex surfaces so they can recurrently pass downwardly and then upwardly through said lint-bearing cotton seeds without applying substantial axially-directed forces to said lint-bearing cotton seeds, said elements recurrently applying and releasing compressive forces to said lint-bearing cotton seeds as they recurrently pass downwardly and then upwardly through said lint-bearing cotton seeds, said recurrent application and release of said compressive forces facilitating absorption of said acid by the lint on said lint-bearing cotton seeds.

15. Apparatus as claimed in claim 14 wherein additional elements on said seed stirring member are adjacent the inner surface of said elongated container, wherein said additional elements extend generally axially of said elongated container and respond to rotation of said seed stirring member to recurrently pass downwardly and then upwardly through said lint-bearing cotton seeds, and wherein said additional members force some of said lint-bearing cotton seeds to move downwardly toward and then upwardly away from the bottom of said elongated container.

16. Apparatus as claimed in claim 14 wherein additional elements on said seed stirring member are adjacent the inner surface of said elongated container, wherein said additional elements extend generally axially of said elongated container and respond to rotation of said seed stirring member to recurrently pass downwardly and then upwardly through said lint-bearing cotton seeds, wherein said additional elements force some of said lint-bearing cotton seeds to move downwardly toward and then upwardly away from the bottom of said elongated container, and wherein said additional elements have generally-flat faces that are displaced radially outwardly from the axis of rotation of said seed stirring member.

17. Apparatus as claimed in claim 14 wherein additional elements on said seed stirring member are adjacent the inner surface of said elongated container, wherein said additional elements extend generally axially of said elongated container and respond to rotation of said seed stirring member to recurrently pass downwardly and then upwardly through said lint-bearing cotton seeds, and wherein said additional elements force some of said lint-bearing cotton seeds to move downwardly toward and then upwardly away from the bottom of said elongated container, wherein said additional elements are displaced radially outwardly from the axis of rotation of said seed stirring member, and wherein said additional elements are secured to and supported by seed-stirring elements on said seed stirring member.

18. Apparatus which comprises an elongated container that can receive and dry acid-treated, lint-bearing cotton seeds, a seed stirring and moving member, supports for said seed stirring and moving member which enable said seed stirring and moving member to rotate relative to said elongated container, a plurality of elements on said seed stirring and moving member which are inclined to the axis of said elongated container and which respond to rotation of said seed stirring and moving member to move said acid-treated lint-bearing cotton seeds axially of said elongated container, and further elements on said seed stirring and moving member which extend outwardly from said seed stirring and moving member and which respond to rotation of said seed stirring and moving member to recurrently pass downwardly and then upwardly through said acid-treated lint-bearing cotton seeds, said further elements having essentially-continuous convex surfaces so they can recurrently pass downwardly and then upwardly through said acid-treated lint-bearing cotton seeds without applying substantial axially-directed forces to said acid-treated lint-bearing cotton seeds, said further elements recurrently applying and releasing compressive forces to said acid-treated lint-bearing cotton seeds as they recurrently pass downwardly and then upwardly through said acid-treated lint-bearing cotton seeds, said recurrent application and release of said compressive forces facilitating drying of said acid-treated lint-bearing cotton seeds.

19. Apparatus as claimed in claim 12 wherein additional elements on said seed stirring and moving member are adjacent the inner surface of said elongated container, wherein said additional elements extend generally axially of said elongated container and respond to rotation of said seed stirring and moving member to recurrently pass downwardly and then upwardly through said acid-treated lint-bearing cotton seeds, and wherein said additional members force some of said acid-treated lint-bearing cotton seeds to move downwardly toward and then upwardly away from the bottom of said elongated container.

20. Apparatus as claimed in claim 1 wherein additional elements on said seed stirring and moving member are adjacent the inner surface of said elongated container, wherein said additional elements extend generally axially of said elongated container and respond to rotation of said seed stirring and moving member to recurrently pass downwardly and then upwardly through said acid-treated lint-bearing cotton seeds, wherein said additional members force some of said acid-treated lint-bearing cotton seeds to move downwardly toward and then upwardly away from the bottom of said elongated container, and wherein said additional elements have generally-flat faces that are displaced radially outwardly from the axis of rotation of said seed stirring and moving member.

21. Apparatus as claimed in claim 19 wherein said elongated container has a perforate bottom, and wherein said elongated container has a jacket that encloses said perforate bottom of said elongated container.

22. Apparatus which comprises a container into which dried acid-treated lint-bearing cotton seeds can be introduced to have the surfaces thereof cleaned and which has a seed-moving member therein, said seed-moving member recurrently urging said dried acid-treated lint-bearing cotton seeds for movement downwardly toward the bottom of said container to cause said dried acid-treated lint-bearing cotton seeds to move into a dense mass of cotton seeds and thereafter progressively urging said dried acid-treated lint-bearing cotton seeds for movement upwardly toward the top of said container to cause said dried acid-treated lint-bearing cotton seeds to move out of said dense mass of cotton seeds and into a less dense mass of cotton seeds.

23. Apparatus as claimed in claim 22 wherein a second container has the inlet thereof adjacent the outlet of the first said container, wherein said seed-moving member in said first said container moves cotton seeds in an upward direction as they approach the outlet of said first said container, and wherein a seed-moving member in said second container moves cotton seeds in a downward direction adjacent said inlet to said second container, whereby cotton seeds which enter said second container are caused to experence a reversal of movement as they enter said inlet of said second container.

24. Apparatus as claimed in claim 22 wherein said seed-moving member has a rotatable shaft and spiders and elongated bars extending between said spiders.

25. Apparatus as claimed in claim 22 wherein said container has a semi-cylindrical bottom, wherein said dried acid-treated lint-bearing cotton seeds are introduced into said container adjacent one side of said semi-cylindrical bottom, and wherein said dried acid-treated lint-bearing cotton seeds are moved circumferentially of said semi-cylindrical bottom to the opposite side of said semi-cylindrical bottom.

26. Apparatus as claimed in claim 22 wherein a second container has the inlet thereof adjacent the outlet of the first said container, wherein a seed-moving member in said second container moves cotton seeds within said chamber, and wherein a vertically-adjustable partition between said containers defines a combined outlet for said first said container and an inlet for said second container of variable size.

* * * * *